US007407374B2

(12) United States Patent
Andersen et al.

(10) Patent No.: US 7,407,374 B2
(45) Date of Patent: Aug. 5, 2008

(54) HYDRAULIC MACHINE

(75) Inventors: René Andersen, Sydals (DK); Kim René Hansen, Soenderborg (DK); Claus Johansen, Soenderborg (DK)

(73) Assignee: Sauer-Danfoss Aps, Nordborg (DK)

( * ) Notice: Subject to any disclaimer, the term of this patent is extended or adjusted under 35 U.S.C. 154(b) by 66 days.

(21) Appl. No.: 11/236,391

(22) Filed: Sep. 27, 2005

(65) Prior Publication Data

US 2006/0067848 A1 Mar. 30, 2006

(30) Foreign Application Priority Data

Sep. 28, 2004 (DE) ..... 10 2004 046 934

(51) Int. Cl.
*F01C 1/02* (2006.01)

(52) U.S. Cl. ..... 418/190; 418/61.3

(58) Field of Classification Search ..... 418/61.3, 418/190

See application file for complete search history.

(56) References Cited

U.S. PATENT DOCUMENTS

| | | | | | |
|---|---|---|---|---|---|
| 3,075,470 | A | * | 1/1963 | Wood | 418/206.6 |
| 3,775,031 | A | * | 11/1973 | Hansen | 418/61.3 |
| 3,953,160 | A | * | 4/1976 | Bottoms | 418/190 |
| 4,145,167 | A | * | 3/1979 | Baatrup | 418/61.3 |
| 4,203,258 | A | | 5/1980 | Held | 51/95 |
| 4,649,671 | A | | 3/1987 | Erhardt et al. | 51/287 |
| 4,859,160 | A | | 8/1989 | White, Jr. | 418/61.3 |
| 5,215,453 | A | * | 6/1993 | Petersen et al. | 418/61.3 |
| 5,320,505 | A | | 6/1994 | Misiak et al. | 418/55.1 |
| 6,126,424 | A | | 10/2000 | Wenker et al. | 418/61.3 |
| 2005/0180873 | A1 | | 8/2005 | Hansen et al. | 418/61.3 |

FOREIGN PATENT DOCUMENTS

| | | |
|---|---|---|
| DE | 1 0209 672 | 10/1956 |
| EP | 0 959 248 A2 | 5/1999 |

OTHER PUBLICATIONS

Eugene A. Avallone and Theodore Baumeister III, Marks' Standard Handbook for Mechanical Engineers—10th Edition, Copyright 1996, Publisher: McGraw-Hill, pp. 5-5 to 5-8.*

* cited by examiner

*Primary Examiner*—Thomas E. Denion
*Assistant Examiner*—Mary A Davis
(74) *Attorney, Agent, or Firm*—McCormick, Paulding & Huber LLP

(57) ABSTRACT

The invention concerns a hydraulic machine with a toothed set comprising a toothed ring with an inner toothing, whose circumferential surface extends in parallel with its axis, and a gear wheel (3) with an outer toothing, whose circumferential surface (24) extends in parallel with its axis, at least one tooth flank having an edge as an axial end of a section, which is located between the circumferential surface and a surface directed radially inwards. It is endeavored to reduce the wear. For this purpose it is ensured that in the radial direction an edge (22, 23) ends so as to be offset inwards in relation to the circumferential surface (24).

17 Claims, 3 Drawing Sheets

HYDRAULIC MACHINE

CROSS-REFERENCE TO RELATED APPLICATIONS

Applicant hereby claims foreign priority benefits under U.S.C. § 119 from German Patent Application No. 10 2004 046 934.2 filed on Sep. 28, 2004, the contents of which are incorporated by reference herein.

FIELD OF THE INVENTION

The invention concerns a hydraulic machine with a toothed set comprising a toothed ring with an inner toothing and a gear wheel with an outer toothing.

BACKGROUND OF THE INVENTION

In a hydraulic machine with a toothed set comprising a toothed ring with an inner toothing, whose circumferential surface extends in parallel with its axis, and a gear wheel with an outer toothing, whose circumferential surface extends in parallel with its axis, at least one tooth flank having an edge as an axial end of a section, which is located between the circumferential surface and a surface directed radially inwards. Such a machine is, for example, known from EP 0 959 248 A2. This machine has clearances or recesses, which can, for example, be made by milling. They are located on both tooth flanks of each tooth of the outer toothing of the gear wheel and are used for a so-called secondary commutation, during which a brief connection to one of the neighbouring pressure chambers is ensured shortly before any pressure chamber reaches a minimum or a maximum volume. At the time of the commutation it is ensured that no connection exists between the pressure chamber in question with maximum or minimum volume, respectively, and the corresponding neighbouring pressure chambers. Thus, a stable operation with low speeds and high pressures should be achieved. At the axial ends of the clearances and at the front edges, the circumferential surfaces extend over edges into end faces of the clearances or the front side of the gear wheel, respectively.

Such machines now turn out to have problems with wear in some areas of the toothed set.

BRIEF SUMMARY OF THE INVENTION

The invention is based on the task of preventing wear.

With a hydraulic machine as mentioned in the introduction, this task is solved in that in the radial direction an edge ends so as to be offset inwards in relation to the circumferential surface.

It is also advantageous that at a clearance is provided in at least one flank, said clearance extending in the axial direction over a predetermined distance, the clearance having edges at its axial ends.

In this connection the circumferential surface is the surface, which forms the toothing. Thus, in a manner of speaking, the circumferential surface extends in a wave shape around the gear wheel or inside the toothed ring, respectively. It defines teeth and tooth spaces. Initially, its every point extends in parallel with the axis of the gear wheel or toothed ring, respectively. Until now, this circumferential surface has only been interrupted by the clearance. This clearance causes that a connection occurs between neighbouring pressure chambers between the two toothings in certain relative positions of gear wheel and toothed ring. In the known case, the clearance extends through an edge into the circumferential surface, the edge being located exactly in the circumferential surface. It has now been established that in the axial direction the toothing on both sides of the clearance are loaded by an increased pressure. While, between the clearance and the front side of the gear wheel or the toothed ring, respectively, the active force can be distributed on a relatively large area, this is not possible in the vicinity of the clearance. Here, the same force is thus concentrated on a substantially shorter area in the axial direction. It is now assumed that this increased surface pressing is causing the increased wear. According to the invention, it is ensured that the clearance is no longer located in the circumferential surface, but is offset inwards in relation to the circumferential surface. This offsetting can be very small. It causes that the increased surface pressing is removed from the immediate vicinity of the clearance. This has the advantage that the axial end wall of the clearance is only loaded to a smaller extent. Exactly here, however, the increased risk of wear exists.

Preferably, a permanent transition face is located between the edge and the circumferential surface. Thus, this transition phase has no steps. This has advantageous effects, when introducing the jacking force in the element of the toothed set, which has the toothing provided with a clearance.

It is particularly advantageous that in the axial direction the transition face has a convex, particularly elliptic, or a straight shape. Both embodiments cause that no additional edge occurs, at which an increased surface pressure could again occur. With a convex shape of the transition face, an "edge" does strictly speaking not exist any more, as here the transition face extends practically in a "rounded" manner into the circumferential surface. In this case, the border between the transition face and the front wall or the end wall, respectively, is regarded as edge.

Preferably, the edge has, in the axial direction, a distance in the range from 1 to 3 mm to the circumferential surface. Thus, the transition area is extremely short. This has the advantageous effect that "leakages" practically do not exist.

It is also advantageous that, at least at the largest depth of the clearance, the edge is offset radially inwards in the range from 0.01 to 0.03 mm in relation to the circumferential surface. As mentioned briefly above, the offsetting of the edge radially inwards is extremely small. It has the size of one to a few hundredth of a millimeter. This has the advantage that the compressive stress or the surface load can also extend into the transition area. Otherwise, there is a risk that the wear problem will simply be displaced axially outwards.

Preferably, a material share between the circumferential surface and the edge is removed by electrolyte-mechanical trimming. This is a relatively simple opportunity of producing a smooth transition between the clearance and the circumferential surface. Only very little material is removed. With the electrolyte-mechanical trimming it is possible to remove this material during the manufacturing of gear wheel or toothed ring, as the electrolyte-mechanical trimming does not take much time. Finally, also grinding tracks or tracks of another purely mechanical material removal are avoided, which could otherwise have an interfering effect on the operation of the hydraulic machine.

Preferably, the tooth flank has, at least on one front side, an end edge, which ends inwardly offset in the radial direction in relation to the circumferential surface. In fact, the same problem exists at the front side than at the transition between the circumferential surface and the clearance. Therefore, a transition face can also be provided at the front side, said transition face having a convex, particularly an elliptic, or a straight shape. This will also reduce the risk of wear at the control system. In a similar manner than with the clearance, the edge can have a distance in the radial direction of 1 to 3 mm to the circumferential surface and can be offset radially inwards by a few hundredth of a millimeter.

It is particularly preferred that each of the two front sides has an end edge, which ends offset radially inwards in relation to the circumferential surface. When, thus, both front sides and both axial ends of the clearance do not immediately extend into the circumferential surface by way of an edge, but this edge is slightly offset radially inwards, so that a transition face occurs, the wear problems are drastically reduced.

BRIEF DESCRIPTION OF THE DRAWINGS

In the following, the invention is described on the basis of a preferred embodiment in connection with the drawings, showing.

DETAILED DESCRIPTION OF THE INVENTION

Figure 1:
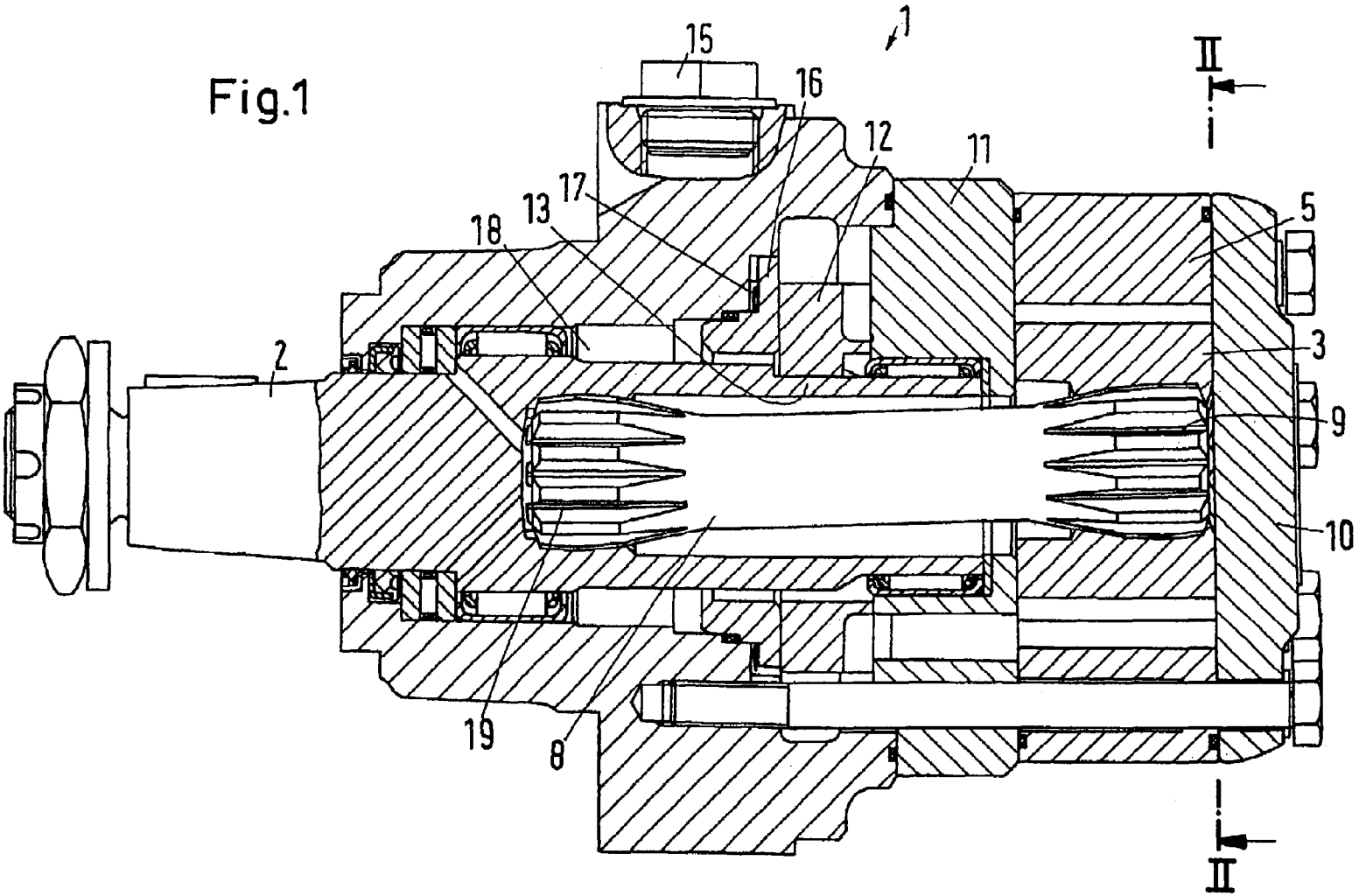
FIG. 1 is a longitudinal section through a hydraulic machine.

A machine shown in FIG. 1 has the form of a motor 1, which has an output shaft 2. The output shaft 2 is driven by a gear wheel 3, which has an outer toothing 4 and rotates and orbits in a toothed ring 5, which has an inner toothing 6 in the form of rolls 7. The output shaft 2 is connected with the gear wheel 3 via a cardan shaft 8, which is inserted in an accordingly suitable toothing 9 on the inside of the gear wheel 3.

On the side turning away from the cardan shaft 8, the toothed set consisting of gear wheel 3 and toothed ring 5 is covered by a cover plate 10. On the opposite side the toothed set is covered by a channel plate 11, which interacts with a valve plate 12. The valve plate 12 engages an extension 13 of the output shaft 2, so that the valve plate 12 rotates synchronously with and in a predetermined angle relation to the gear wheel 3.

Figure 2:
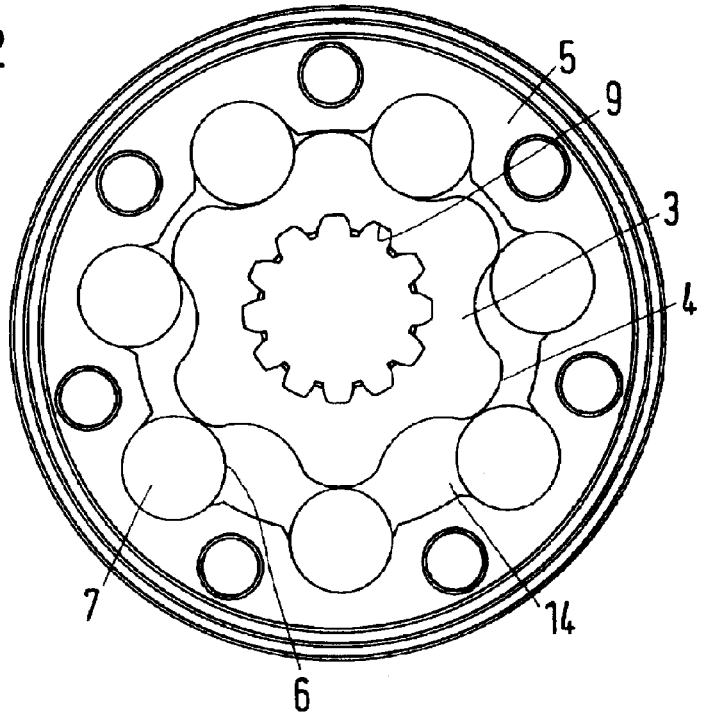
FIG. 2 is a section II-II according to FIG. 1.

The channel plate 11 and the valve plate 12 form a valve arrangement, which controls, by means of a connection arrangement 15, of which merely one connection can be seen in FIG. 1, the supply of pressure chambers 14, which are formed between gear wheel and toothed ring 5 (FIG. 2). The connection arrangement 15 has a high-pressure connection, at which pressurised hydraulic fluid is supplied to the motor, and a low-pressure connection, through which the hydraulic fluid can flow off from the motor.

In order to ensure the tightness between the valve plate 12 and the channel plate 11, a balancing plate 16 is provided, which is located on the side of the valve plate 12 facing the channel plate 11. The balancing plate 16 is loaded in the direction of the valve plate 12 by a pressure spring 17. This ensures the corresponding tightness between channel plate 11 and valve plate 12 during the start. Later the required force on the valve plate 12 is then ensured by a pressure in a pressure chamber 18, in which a corresponding oil pressure builds up during operation of the motor.

By means of a further toothing 19, the cardan shaft 8 is connected with the output shaft 2. Neither at the toothing 9 nor at the toothing 19 a play can be completely avoided. Particularly with large loads it is further possible that the cardan shaft 8 is twisted. The sum of these events now contribute to the fact that the supply in the correct position of the individual pressure chambers 14 between the toothed ring 5 and the gear wheel 3 in relation to the valve commutation is no longer ensured in the manner, which would usually be required.

Problems particularly occur, when the volume of a pressure chamber 14 has reached its maximum value, and when, after passing this maximum value, the pressure chamber starts contracting. In this case it is required that a connection exists between this pressure chamber and the outlet or low-pressure connection. If, however, at this instant, the pressure chamber is connected with the high-pressure connection, pressure surges occur, which have a negative effect on the operation behaviour of the machine. This is particularly the case with low speeds. The same problem occurs, when the volume of the pressure chamber 14 has passed a minimum value and starts expanding. In this case, a connection of this pressure chamber with the high-pressure connection is required. When, however, this pressure chamber is still connected with the low-pressure connection, there is a risk that cavitation may occur. Thus, problems always occur, when a pressure chamber assumes an extreme value of its volume.

Figure 3:
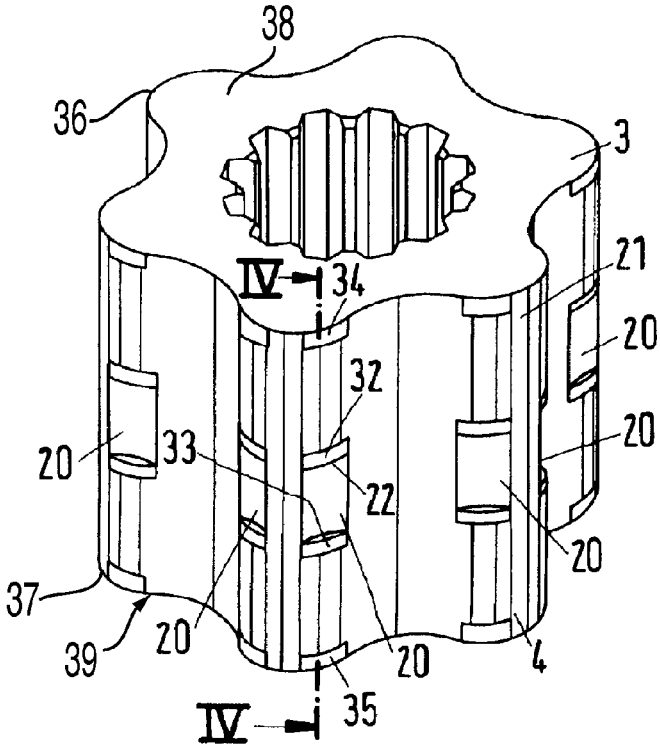
FIG. 3 is a perspective view of a gear wheel.

To remedy these problems, the gear wheel 3, as shown in FIG. 3, having a first axial end 36 and a second axial end 37, with first and second axial end surfaces 38 and 39, respectively, is provided with clearances 20 on the flanks of the teeth 21 forming its outer toothing 4. In this connection, the clearances 20 are located approximately in the axial center of the gear wheel 3. They have an axial extension in the range from 2 to 50% of the axial length of the gear wheel 3. Their extension in the circumferential direction is described in connection with the FIGS. 4*a* to 5*b*.

The clearances 20 serve the so-called secondary commutation. They ensure that until a time shortly before reaching a minimum or a maximum volume of any pressure chamber a connection outside the valve arrangement to the respective neighbouring pressure chambers 14 is provided. Depending of the extension of the clearances 20 in the rotation direction it can also be ensured that a short-circuit between neighbouring pressure chambers is generated, when a pressure chamber has an extreme value of its volume.

In principle, the embodiment of such a machine is known from EP 0 959 248 A2 or DE 102 09 672 B3.

Figure 4A:
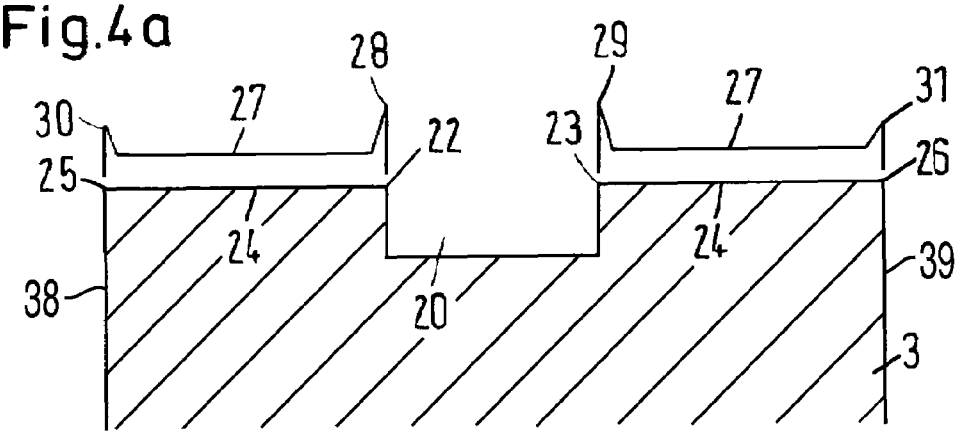
FIG. 4 is a schematic section along the line IV-IV according to FIG. 3.

FIG. 4*a* is a schematic view of a section through the gear wheel 3 in the area of a tooth 21; more particularly, through a flank of the tooth 21, in which the clearance 20 is located. The section extends through the area of the clearance 20, in which it has its maximum depth.

With an edge 22, 23, the clearance 20 extends into the circumferential surface 24 of the gear wheel 3. Here, the circumferential surface corresponds to the contour line of the gear wheel 3 shown in FIG. 2, which has been extruded perpendicularly to the drawing level of FIG. 2. In each point in the circumferential direction this circumferential surface 24 extends in parallel to the axis of the gear wheel 3.

Also on both front sides of the gear wheel 3 edges 25, 26 occur, with which the front sides of the gear wheel 3 extend into the circumferential surface 24.

In FIG. 4*a* a curve 27 shows the course of the compressive stress in the contact areas between the teeth 21 of the gear wheel 3 and the roller set of the toothed ring 5. It can be seen that the curve 27 of the compressive stress is substantially constant in the axial direction. Merely in the areas of the edges 22, 23 compressive stress peaks 28, 29 occur. In the area of the front side edges 25, 26 smaller compressive stress peaks 30, 31 occur.

Figure 4B:
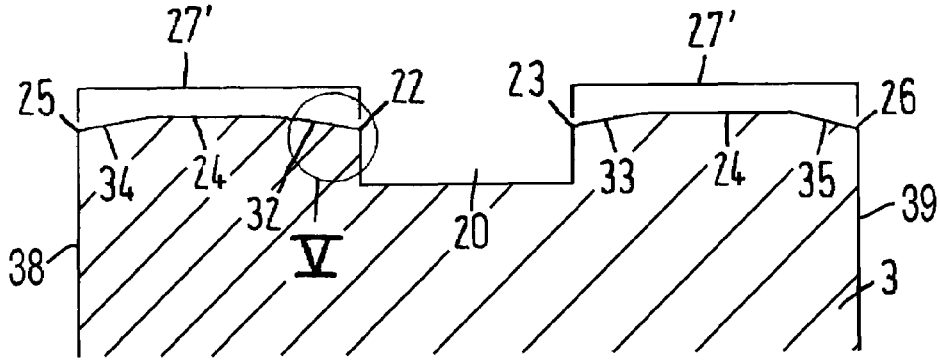
Figure 5A:
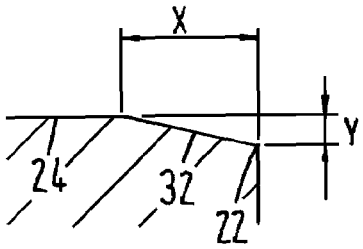
FIG. 5 is an enlarged view of the detail V in FIG. 4*b*.

In order to avoid these peaks 28 to 31, the edges 22, 23 and 25, 26 are slightly offset radially inwards in the embodiment according to FIG. 4*b*. For example between the edge 22 and the circumferential surface 24, this results in a transition face 32, which is also shown in FIG. 3. With the other edges 23, 25, 26, transition faces 33 to 35 occur. These transition faces 32 to 35 are shown excessively large in the FIGS. 3 and 4*b*. Their dimensioning occurs from FIG. 5. The transition face 32 in FIG. 5*a* shows an extension X in the axial direction, which is in the range from 1 to 3 mm. These dimensions apply for the edges 22, 23 in the area of the clearances 20. With the edges 25, 26, the axial extension x can be substantially smaller, for example 10% to 50% of the extension X at the clearance 20. In the radial direction it has an extension Y, which is in the range from 0.01 to 0.03 mm. The transition face 32 in FIG. 5*a* has the shape of a straight or plane surface, that is, it is stepless. The transition into the circumferential surface 24 should possibly occur in a rounded manner, that is, without edge, to prevent the generation of new compressive stress peaks. The transition face 32 has a relatively small inclination of approximately 2%. This makes it possible for the compressive stress according to curve 27' in FIG. 4*b* to extend into the transition face 32, so that no increased compressive stresses occur on the transition from the transition face 32 into the circumferential face 24, which compressive stresses could cause wear.

The transition face 32 according to FIG. 5*a* can, for example, be made by electrolyte-mechanical trimming. With this working relatively little material is removed. However, the removal of the material takes a relatively short time, so that this working process can easily be integrated in the manufacturing process of the gear wheel 3.

Figure 5B:
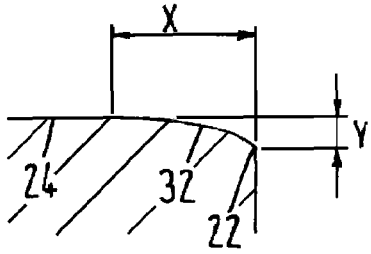

FIG. 5*b* shows a modified embodiment of the transition face 32, which is here concavely curved. The best solution has turned out to be an ellipse-shaped curvature. The dimensioning is similar to that in FIG. 5*a*, that is, the axial extension of the transition face is in the range from 1 to 3 mm and the radial distance Y of the edge 22 from the circumferential surface 24 is in range of a few hundredth millimeters, for example 1/100 mm to 3/100 mm. The transition areas 33, 34, 35 can of course be made in a corresponding manner, so that the pressure peaks 29 to 31 can reliably be avoided. It has turned out that a gear wheel 3 manufactured in this manner shows substantially less wear than a gear wheel 3 according to FIG. 4*a*, in which the edges 22, 23, 25, 26 are practically located in the circumferential surface 24.

The distance Y of the edge 22 from the circumferential surface 24 shown in FIGS. 5*a* and 5*b*, refers approximately to the circumferential centre of the clearance 20. It is obvious that in relation to the circumferential edges of the clearance 20 also smaller distances can be permitted, without interfering with the stress reduction. However, the radial offsetting of the edges 22, 23 in relation to the circumferential surface should cover the total width of the clearance 20 in the circumferential direction. The width (in the circumferential direction) of the radially offset edges 25, 26 is exactly as large.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A hydraulic machine with a toothed set comprising:

a toothed ring with an inner toothing, whose circumferential surface extends in parallel with its axis; and a gear wheel with an outer toothing, whose circumferential surface extends in parallel with its axis, at least one tooth flank having at least one edge, which, in the axial direction, is located between the circumferential surface and a surface directed radially inwards;

wherein in the radial direction the at least one edge is offset inwards in relation to the circumferential surface; and wherein a transition face is located between the edge and the circumferential surface such that one edge of the transition face is the at least one edge and the opposite edge of the transition face is formed with the circumferential surface.

2. The hydraulic machine according to claim 1, wherein a clearance is provided in the at least one tooth flank, said clearance extending in the axial direction over a predetermined distance, the at least one edge being located at an axial end of the clearance.

3. The hydraulic machine according to claim 1, wherein in the axial direction the transition face has a convex or a straight shape.

4. The hydraulic machine according to claim 1, wherein the edge is, in the axial direction, a distance in the range from 1 to 3 mm from the circumferential surface.

5. The hydraulic machine according to claim 2, wherein at least at the largest depth of the clearance, the edge is offset radially inwards in the range from 0.01 to 0.03 mm in relation to the circumferential surface.

6. The hydraulic machine according to claim 1, wherein the transition face is formed by removing material between the circumferential surface and the edge by electrolyte-mechanical trimming.

7. The hydraulic machine according to claim 1, wherein the at least one edge is located between the circumferential surface and an axial end surface of the gear wheel.

8. A hydraulic machine with a toothed set comprising:

a toothed ring with an inner toothing, whose circumferential surface extends in parallel with its axis; and a gear wheel with an outer toothing, whose circumferential surface extends in parallel with its axis, at least one tooth flank having at least one edge, which, in the axial direction, is located between the circumferential surface and a surface directed radially inwards;

wherein in the radial direction the at least one edge is offset inwards in relation to the circumferential surface;

wherein the at least one edge is located between the circumferential surface and an axial end surface of the gear wheel;

wherein another edge which, in the axial direction, is located between the circumferential surface and an opposite axial end surface of the gear wheel, is offset radially inwards in relation to the circumferential; and wherein a transition face is located between the edge and the circumferential surface such that one edge of the transition face is the at least one edge and the opposite edge of the transition face is formed with the circumferential surface.

9. A hydraulic machine with a toothed set comprising:

a toothed ring with an inner toothing, whose circumferential surface extends in parallel with its axis; and a gear wheel with an outer toothing, whose circumferential surface extends in parallel with its axis, at least one tooth flank having at least one edge, which, in the axial direction, is located between the circumferential surface and a surface directed radially inwards;

wherein in the radial direction the at least one edge is offset inwards in relation to the circumferential surface;

wherein a clearance is provided in the at least one tooth flank, said clearance extending in the axial direction over a predetermined distance, the at least one edge being located at an axial end of the clearance; and wherein another edge located at the other axial end of the clearance is also offset inwards in relation to the circumferential surface.

10. The hydraulic machine according to claim 3, wherein the transition face has a convex elliptical shape.

11. A gear wheel for a hydraulic machine, the gear wheel comprising:

a gear wheel body extending in an axial direction; and a plurality of teeth extending radially outwards from the gear wheel body, each tooth having an outer surface and extending in the axial direction between first and second axial end surfaces;

wherein at least one transition face is formed on at least one of the plurality of teeth, the at least one transition face being located, in the axial direction, between the outer surface and another surface angularly offset from the outer surface, the at least one transition face being angularly offset from the outer surface to a smaller degree than the other surface;

wherein at least one clearance is formed in the outer surface of the at least one tooth, the at least one transition face being located between the outer surface and an axial edge of the at least one clearance; and wherein another transition face is located between the outer surface of the at least one tooth and another axial edge of the at least one clearance.

12. The gear wheel of claim 11, wherein another clearance is formed in the outer surface of the at least one tooth, an additional transition face being located between each axial edge of the other clearance and the outer surface of the at least one tooth.

13. The gear wheel of claim 12, wherein the two clearances are located on different flanks of the at least one tooth.

14. The gear wheel of claim 11, wherein the at least one transition face is located between the outer surface and the first axial end surface of the at least one tooth.

15. The gear wheel of claim 14, wherein another transition face is located between the outer surface and the second axial end surface of the at least one tooth.

16. The gear wheel of claim 11, wherein the first and second axial end surfaces of the teeth are substantially flush with corresponding axial end surfaces of the gear wheel body.

17. The gear wheel of claim 11, wherein each of the plurality of teeth is substantially identical.

* * * * *